US009754527B2

(12) United States Patent
Jung et al.

(10) Patent No.: US 9,754,527 B2
(45) **Date of Patent: *Sep. 5, 2017**

(54) FLAT DISPLAY DEVICE WITH ALTERNATING WHITE IMAGE DRIVING PERIODS

(71) Applicant: LG DISPLAY CO., LTD., Seoul (KR)

(72) Inventors: Ki-Moon Jung, Paju-si (KR); Chong-Hun Park, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/869,620

(22) Filed: Sep. 29, 2015

(65) Prior Publication Data

US 2016/0049112 A1 Feb. 18, 2016

Related U.S. Application Data

(63) Continuation of application No. 14/575,930, filed on Dec. 18, 2014, now Pat. No. 9,165,496.

(30) Foreign Application Priority Data

Aug. 14, 2014 (KR) ..... 10-2014-0105761

(51) Int. Cl.
*G09G 3/3275* (2016.01)
*G09G 3/3225* (2016.01)
(Continued)

(52) U.S. Cl.
CPC ..... *G09G 3/2092* (2013.01); *G09G 3/2003* (2013.01); *G09G 3/2074* (2013.01);
(Continued)

(58) Field of Classification Search
None
See application file for complete search history.

(56) References Cited

U.S. PATENT DOCUMENTS 8,531,367 B2 * 9/2013 Son ..... G09G 3/3607 345/88
2005/0140636 A1 * 6/2005 Chung ..... G09G 3/3413 345/98

(Continued)

FOREIGN PATENT DOCUMENTS

KR 10-0666632 B1 1/2007
KR 100666632 B1 * 1/2007
KR 10-2014-0087915 A 7/2014

OTHER PUBLICATIONS

U.S. Appl. No. 14/575,930, filed Dec. 18, 2014.

*Primary Examiner* — Kumar Patel
*Assistant Examiner* — Amy C Onyekaba
(74) *Attorney, Agent, or Firm* — Birch, Stewart, Kolasch & Birch, LLP

(57) ABSTRACT

A flat display device includes a display panel. The display panel includes a unit pixel, the unit pixel having a red sub-pixel, a green sub-pixel, a blue sub-pixel, and a white sub-pixel. The flat display device further includes a panel driving unit to drive the flat panel in a first driving period and a second driving period in an alternating manner to display a white image on the unit pixel. The panel driving unit generates first white unit data, to enable two of the red, green, and blue sub-pixels and the white sub-pixel to be driven in the first driving period. The panel driving unit generates second white unit data, to enable three of the sub-pixels, which include the sub-pixel not driven in the first driving period, to be driven in the second driving period.

10 Claims, 8 Drawing Sheets

(51) Int. Cl.
*G09G 3/20* (2006.01)
*G09G 3/36* (2006.01)

(52) U.S. Cl.
CPC ..... *G09G 3/3225* (2013.01); *G09G 3/3275* (2013.01); *G09G 3/3607* (2013.01); *G09G 2300/0426* (2013.01); *G09G 2300/0452* (2013.01); *G09G 2300/0819* (2013.01); *G09G 2310/0235* (2013.01); *G09G 2320/029* (2013.01); *G09G 2320/0219* (2013.01); *G09G 2320/0242* (2013.01); *G09G 2320/043* (2013.01); *G09G 2320/045* (2013.01); *G09G 2320/048* (2013.01); *G09G 2320/0666* (2013.01); *G09G 2330/027* (2013.01); *G09G 2330/028* (2013.01); *G09G 2340/06* (2013.01)

(56) References Cited

U.S. PATENT DOCUMENTS

| | | | | |
|---|---|---|---|---|
| 2005/0285828 | A1* | 12/2005 | Inoue | G09G 3/3208 345/76 |
| 2007/0236422 | A1* | 10/2007 | Park | G09G 3/3233 345/76 |
| 2009/0135207 | A1* | 5/2009 | Tseng | G09G 3/3607 345/690 |
| 2012/0212515 | A1* | 8/2012 | Hamer | G09G 3/2003 345/690 |
| 2014/0268633 | A1* | 9/2014 | Kwon | G09G 3/2025 362/84 |

* cited by examiner

FLAT DISPLAY DEVICE WITH ALTERNATING WHITE IMAGE DRIVING PERIODS

CROSS REFERENCE TO RELATED APPLICATIONS

This application is a Continuation of co-pending U.S. application Ser. No. 14/575,930 filed on Dec. 18, 2014, which claims the benefit of the Korean Patent Application No. 10-2014-0105761, filed on Aug. 14, 2014. All these applications are hereby incorporated by reference as if fully set forth herein.

BACKGROUND OF THE INVENTION

Field of the Invention

The present invention relates to a flat display device and, more particularly, to a flat display device capable of preventing variation in a threshold voltage of a driving transistor during rendering of a white image.

Discussion of the Related Art

Flat display devices in related art include liquid crystal displays (LCDs) and plasma displays (PDPs) which are thin, light, and portable and have high performance, and organic light emitting display devices which may eliminate disadvantages of heavy weight and bulky cathode ray tubes (CRTs).

Such flat display devices include unit pixels each constituted by a red sub-pixel, a green sub-pixel, and a blue sub-pixel, to display an image of various colors. Each unit pixel in flat display devices further includes a white sub-pixel, in addition to red, green, and blue sub-pixels. The white sub-pixel does not require a color filter and exhibits higher transmittance than the remaining sub-pixels. In this regard, an enhancement in efficiency is achieved. Such a flat display device, which includes a white sub-pixel, displays an image by transforming input data of three colors, namely, red, green, and blue, into data of four colors, namely, red, green, blue, and white. In particular, in conventional four-color flat display devices, a white image is displayed through a combination of two of the red, green, and blue sub-pixels and the white sub-pixel. When a white image is rendered for a lengthened period of time, threshold voltages of driving transistors of the non-driving sub-pixels (e.g., transistors connected to organic light emitting diodes in an organic light emitting display device or transistors connected to pixel electrodes in a liquid crystal display device) are shifted in the negative direction due to stress applied to the driving transistors (e.g., negative bias temperature illumination stress (NTBis)), as compared to those of the driving sub-pixels. To solve this problem, a data voltage may be shifted to compensate for the shifted levels of the threshold voltages at the outside. However, the range of compensation is limited and, as such, there is a limitation on compensation. In particular, when the threshold voltages are continuously shifted in the negative direction beyond the compensation range, luminance may be increased and, as such, degradation of reliability may occur.

SUMMARY OF THE INVENTION

Accordingly, the present invention is directed to a flat display device that substantially obviates one or more problems due to limitations and disadvantages of the related art.

The flat display device is capable of preventing variation in a threshold voltage of a driving transistor during rendering of a white image.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings. Both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and along with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
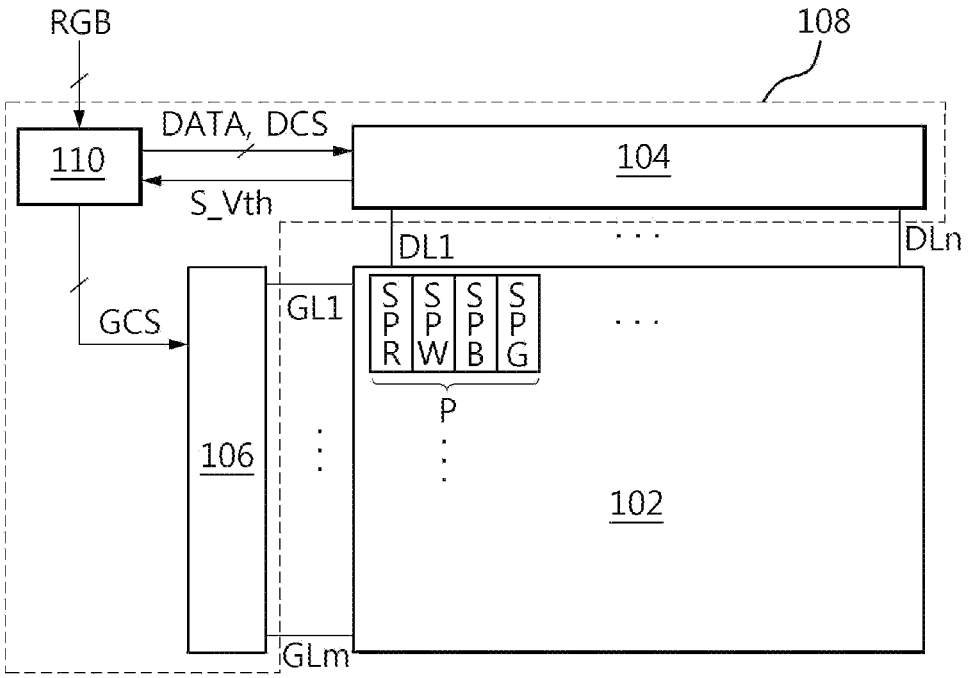
FIG. 1 is a block diagram illustrating an organic light emitting display device according to a first embodiment of the present invention.

FIG. 1 is a block diagram illustrating an organic light emitting display device according to a first embodiment of the present invention. The display device includes a panel driving unit 108 including a data driver 104, a scan driver 106 and a timing controller 110, and a light emitting display panel 102. The light emitting display panel 102 includes a plurality of unit pixels P each including a red sub-pixel SPR, a green sub-pixel SPG, a blue sub-pixel SPB, and a white sub-pixel SPW. Arrangement of the sub-pixels in each unit pixel P may be very diverse. The arrangement of the red sub-pixel SPR, white sub-pixel SPW, blue sub-pixel SPB, and green sub-pixel SPG illustrated in FIG. 1 is illustrative and, as such, the present invention is not limited thereto. Each of the sub-pixels SPR, SPG, SPW, and SPB is formed at a pixel region provided in accordance with intersection of one gate line GL and one data line DL.

Figure 2:
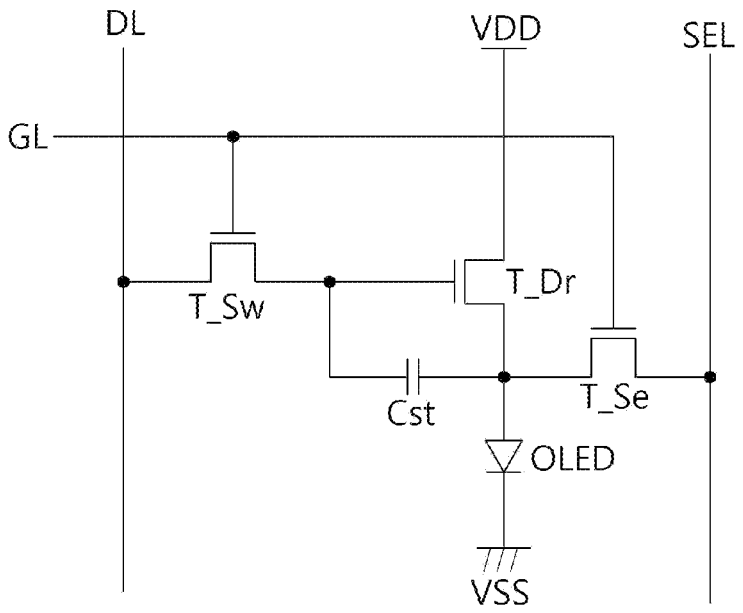
FIG. 2 is a circuit diagram explaining sub-pixels of the organic light emitting display device illustrated in FIG. 1.

Next, FIG. 2 illustrates each of the sub-pixels SPR, SPG, SPW, and SPB includes a switching transistor T_SW, a driving transistor T_Dr, a storage capacitor Cst, a sensing transistor T_Se, and an organic light emitting diode OLED. The organic light emitting diode OLED operates to emit light in accordance with drive current generated by the driving transistor T_Dr. The switching transistor T_Sw performs a switching operation in response to a gate signal supplied via the gate line GL to store a data signal supplied via the data line DL in the storage capacitor Cst. The driving transistor T_Dr operates to allow drive current to flow between a high-level voltage line VDD and a low-level voltage line VSS in accordance with a data voltage stored in the storage capacitor Cst. The sensing transistor T_Se supplies, to a source electrode of the driving transistor T_Dr, a reference voltage Vref supplied to a sensing line SEL in response to the gate signal supplied via the gate line GL. A threshold voltage of the driving transistor T_Dr is sensed via the sensing transistor T_Se and sensing line SEL, and the data voltage is compensated in proportion to a difference between the sensed threshold voltage and a reference threshold voltage. The configurations of the sensing transistor T_Se and sensing line SEL are very diverse. The structure of FIG. 2 is illustrative and, as such, the present invention is not limited thereto.

The light emitting display panel 102 includes two of the red sub-pixel SPR, green sub-pixel SPG, blue sub-pixel SPB and the white sub-pixel SPW in the unit pixel P emit light in a first driving period, thereby enabling the corresponding unit pixel P to render white. In a second driving period alternating with the first driving period, three of the sub-pixels in the unit pixel P, which include the sub-pixel not driven in the first driving period, emit light, thereby causing the corresponding unit pixel P to render white.

To display a white image on the unit pixel P, the panel driving unit 108 drives two of the red sub-pixel SPR, green sub-pixel SPG, and blue sub-pixel SPB and the white sub-pixel SPW in the unit pixel P during the first driving period, and drives three of the sub-pixels in the unit pixel P, which include the sub-pixel not driven in the first driving period, during the second driving period alternating with the first driving period. The following description will be given in conjunction with an example in which the green sub-pixel SPG does not emit light during the first driving period, and the white sub-pixel SPW does not emit light during the second driving period. In the first driving period, the green sub-pixel SPG displays a black image because the green sub-pixel SPG does not emit light. In the second driving period, the white sub-pixel SPW displays a black image because the white sub-pixel SPW does not emit light. The first and second driving periods are set in accordance with a variation degree of the threshold voltage of the driving transistor T_Dr in the green sub-pixel SPG.

The data driver 104 which is included in the panel driving unit 108 along with the scan driver 106 and the timing controller 110 converts digital pixel data into an analog data voltage, based on a data control signal DCS and a gamma voltage supplied from the timing controller 110. The data driver 104 supplies the analog data voltage to each data line DL. The gate driver 106 supplies a scan voltage having a high level or a low level to gate lines GL1 to GLm formed at the light emitting display panel 102 in response to a gate control signal GCS from the timing controller 110.

Figure 3:
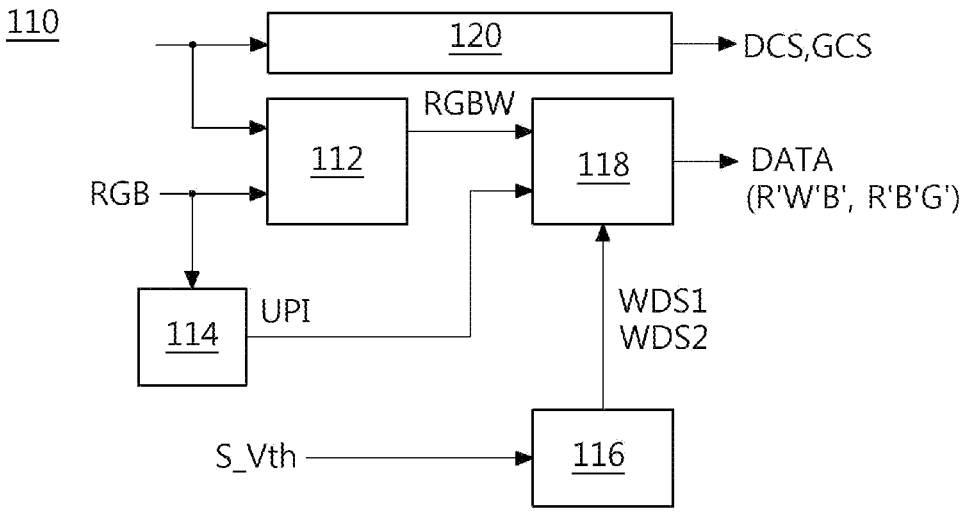
FIG. 3 is a block diagram explaining a timing controller illustrated in FIG. 1.

Next, FIG. 3 illustrates the timing controller 110 which includes a control signal generator 120, a four-color data transformer 112, a unit pixel information unit 114, a sensing data processor 116, and a pixel data processor 118. The control signal generator 120 generates a gate control signal GCS and a data control signal DCS, based on a synchronization signal input from the outside, to control respective driving timings of the gate driver 106 and data driver 104. The generated gate control signal GCS is supplied to the gate driver 106, and the generated data control signal DCS is supplied to the data driver 104.

The four-color data transformer 112 transforms red, green and blue input data RGB for each unit pixel input from the outside on a per frame basis into red, green, blue, and white pixel data RGBW. For example, the four-color data transformer 112 generates white pixel data W, based on input data RGB having a minimum grayscale value (or a common grayscale value) among red, green, and blue input data RGB for each unit pixel. The four-color data transformer 112 then generates red, green, and blue pixel data R, G, and B by applying the generated white pixel data W to the red, green, and blue input data RGB. In this case, the four-color data transformer 112 may generate the red, green, and blue pixel data R, G, and B by deducting the white pixel data W from respective red, green, and blue input data RGB.

The unit pixel information unit 114 analyzes red, green and blue input data RGB for each unit pixel input from the outside on a per frame basis, and generates information as to a white unit pixel position, at which a white image will be displayed, or the like, based on results of the analysis. The unit pixel information unit 114 supplies the generated white unit pixel information UPI to the pixel data processor 118.

The sensing data processor 116 senses a threshold voltage of the driving transistor of the green sub-pixel SPG at intervals of a predetermined time, and compares a difference between the sensed threshold voltage S_Vth and a reference threshold voltage with first and second critical values. Here, the reference threshold voltage may be a threshold voltage of the driving transistor of the green sub-pixel SPG sensed via the sensing transistor T_Se and sensing line SEL before or after shipment of the organic light emitting device.

In detail, when a white image is rendered using first white unit data R'W'B', the sensing data processor 116 determines whether the difference between the sensed threshold voltage S_th and the reference threshold voltage is greater than the first critical value. When the threshold voltage difference is greater than the first critical value, the sensing data processor 116 generates a second white drive signal WDS2. When the threshold voltage difference is smaller than or equal to the first critical value, the sensing data processor 116 generates a first white drive signal WDS1.

When a white image is rendered using second white unit data R'B'G', the sensing data processor 116 determines whether the difference between the sensed threshold voltage S_th and the reference threshold voltage is smaller than the second critical value. When the threshold voltage difference is smaller than the second critical value, the sensing data processor 116 generates the first white drive signal WDS1. When the threshold voltage difference is equal to or greater than the second critical value, the sensing data processor 116 generates the second white drive signal WDS2.

The pixel data processor 118 arranges four-color data RGBW for each pixel supplied from the four-color data transformer 112 in response to the first and second white drive signals WDS1 and WDS2, to match the four-color data RGBW with the sub-pixel arrangement of the light emitting display panel 102. The pixel data processor 118 then supplies the arranged data to the data driver 104. The pixel data processor 118 alternately supplies first white unit data R'W'B' for non-emission of the green sub-pixel SPG and second white unit data R'B'G' for non-emission of the white sub-pixel SPW in accordance with a variation degree of the threshold voltage of the driving transistor T_Dr in the green sub-pixel SPG.

In detail, the pixel data processor 118 extracts red, white, and blue sub-pixel data from four-color data for each unit pixel supplied from the four-color data transformer 114, in response to the first white drive signal WDS1 from the sensing data processor 116.

Figure 4A:
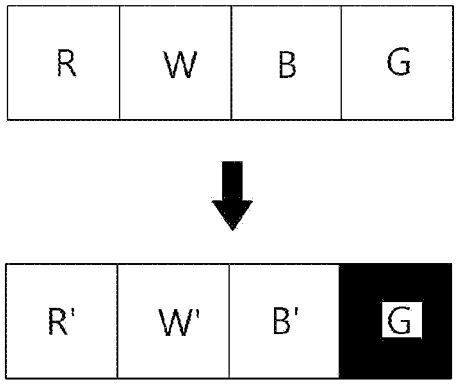
FIGS. 4A and 4B are diagrams explaining driving of a pixel data processor illustrated in FIG. 3.

Next, FIG. 4A illustrates the pixel data processor 118 that corrects the extracted data into first white unit data R'W'B' having color coordinates according to a predetermined target white luminance. The pixel data processor 118 supplies the first white unit data R'W'B' to the data driver 104. Accordingly, the white unit pixel P corresponding to white unit pixel information UPI from the unit pixel information unit 114 displays a white image corresponding to the predetermined color coordinates in accordance with emission of the red, white, and blue sub-pixels SPR, SPW, and SPB in the white unit pixel P. In this case, the green sub-pixel SPG in the white unit pixel P displays a black image due to non-emission thereof. In response to the second white drive signal WDS2 from the sensing data processor 116, the pixel data processor 118 extracts red, green, and blue sub-pixel data from four-color data for each unit pixel supplied from the four-color data transformer 114.

Figure 4B:
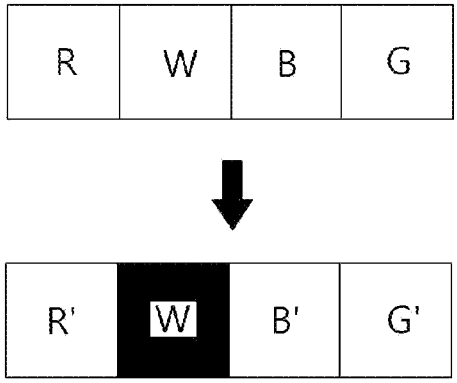

Next, FIG. 4B illustrates the pixel data processor 118 that then corrects the extracted data into second white unit data R'B'G' having color coordinates according to a predetermined target white luminance. The pixel data processor 118 supplies the second white unit data R'B'G' to the data driver 104. Accordingly, the white unit pixel P corresponding to white unit pixel information UPI from the unit pixel information unit 114 displays a white image corresponding to the predetermined color coordinates in accordance with emission of the red, green, and blue sub-pixels SPR, SPG, and SPB in the white unit pixel P. In this case, the white sub-pixel SPW in the white unit pixel P displays a black image due to non-emission thereof.

Figure 5:
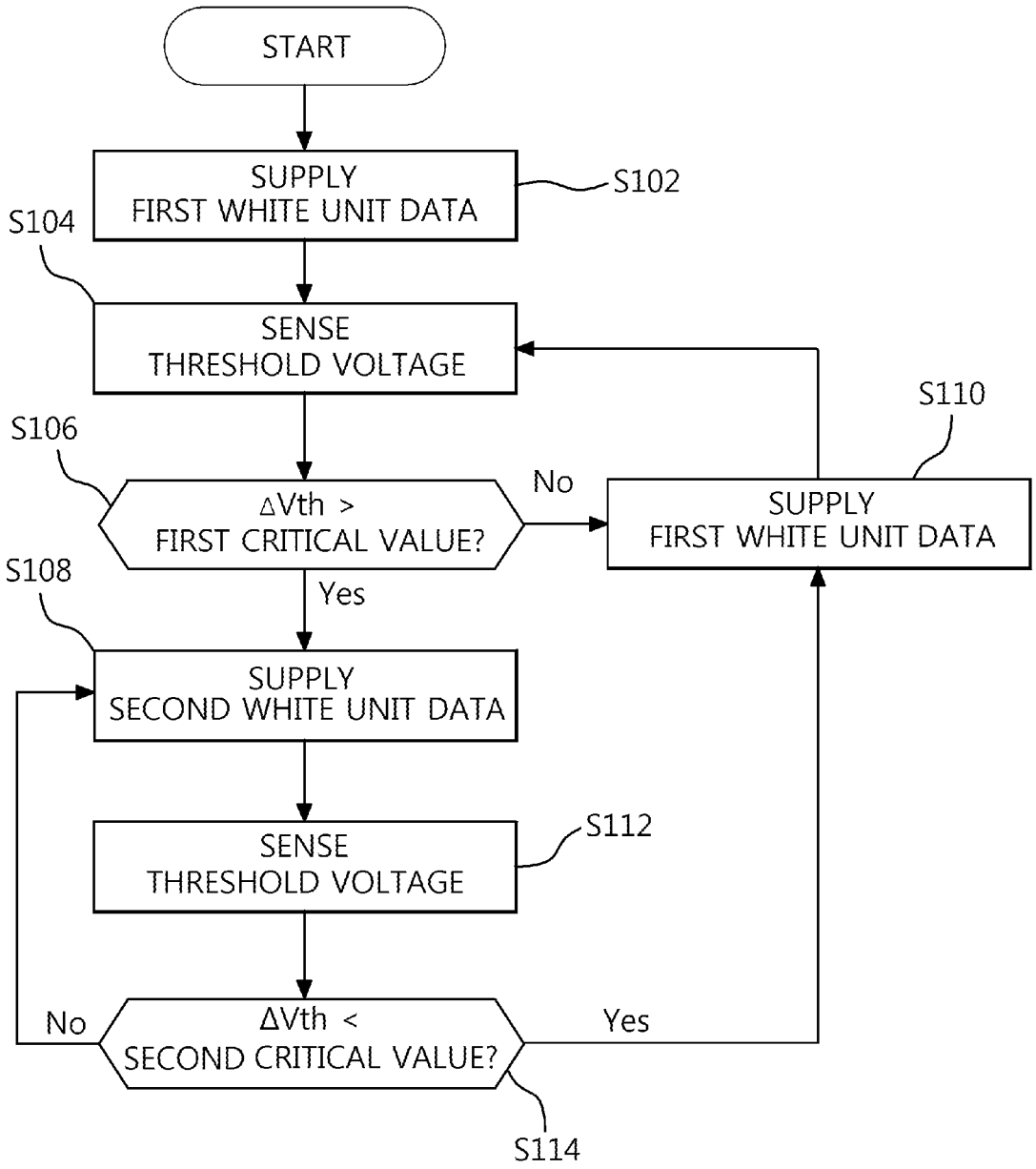
FIG. 5 is a flowchart explaining a method for driving the organic light emitting display device illustrated in FIG. 1.

Next, FIG. 5 is a flowchart explaining a method for driving the organic light emitting display device according to the first embodiment of the present invention. When the organic light emitting display device is initially driven after being powered on, first white unit data R'W'B' is supplied to display a white image on a corresponding unit pixel (S102). The threshold voltage of the green sub-pixel SPG of the unit pixel is then sensed at intervals of a predetermined time (for example, several seconds, several minutes, or several hours) (S104). Thereafter, it is determined whether the difference between the sensed threshold voltage S_Vth and the reference threshold voltage, ΔVth, is greater than the first critical value (S106). When the threshold voltage difference ΔVth is smaller than or equal to the first critical value, the first white unit data R'W'B' is continuously supplied to continuously display the white image on the corresponding unit pixel (S110). When the threshold voltage difference ΔVth is greater than the first critical value, second white unit data R'G'B' is supplied to display a white image on the corresponding unit pixel (S112).

Thereafter, the threshold voltage of the green sub-pixel SPG of the unit pixel is sensed at intervals of a predetermined time (for example, several seconds, several minutes, or several hours) (S112). It is then determined whether the difference ΔVth between the sensed threshold voltage S_Vth and the reference threshold voltage is smaller than the second critical value (S114). When the threshold voltage difference ΔVth is smaller than the second critical value, the first white unit data R'W'B' is supplied to display the white image on the corresponding unit pixel (S110). When the threshold voltage difference ΔVth is equal to or greater than the second critical value, the second white unit data R'G'B' is continuously supplied to continuously display a white image on the corresponding unit pixel (S108).

When a white image is displayed during the first driving period, using the first white unit data R'W'B', as described above, the threshold voltage of the driving transistor of the non-emitting green sub-pixel SPG is shifted to a certain value in the negative direction. Accordingly, during the second driving period, a white image is displayed, using the second white unit data R'B'G' for emission of the green sub-pixel SPG. As a result, it may be possible to prevent the threshold voltage of the green sub-pixel SPG from being shifted in the negative direction beyond a compensation range. When a white image is displayed during the second driving period, using the second white unit data R'B'G', the threshold voltage of the driving transistor of the emitting green sub-pixel SPG is shifted to a certain value in the positive direction. Accordingly, during the first driving period, a white image is displayed, using the first white unit data R'W'B' for non-emission of the green sub-pixel SPG. As a result, it may be possible to prevent the threshold voltage of the green sub-pixel SPG from being shifted in the positive direction beyond a compensation range.

Figure 6:
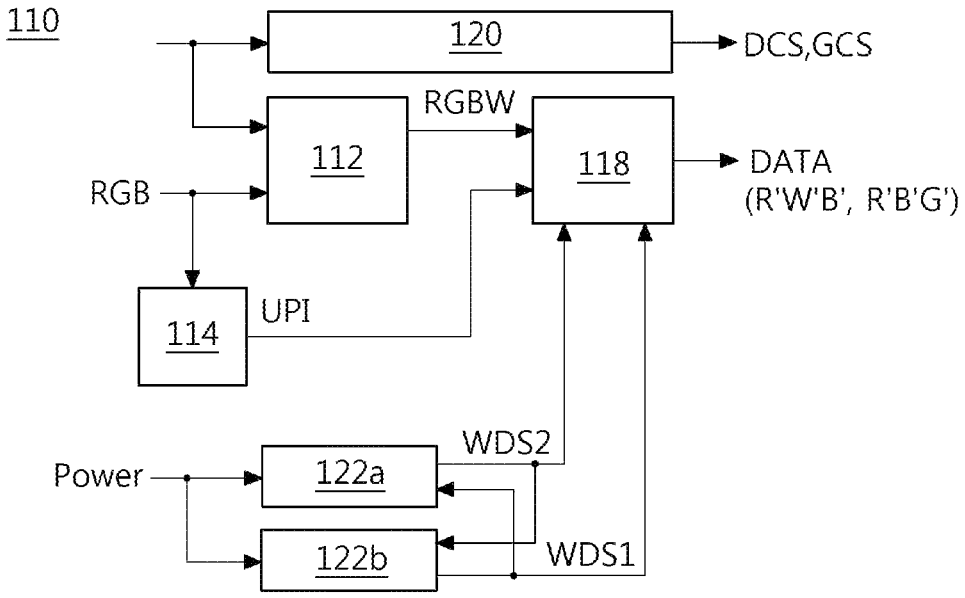
FIG. 6 is a block diagram illustrating a timing controller included in a flat display device according to a second embodiment of the present invention.

Next, FIG. 6 is a block diagram illustrating a flat display device according to a second embodiment of the present invention. The flat display device according to the second embodiment of the present invention includes similar constituent elements as the flat display device according to the first embodiment of the present invention, except that the first and second driving periods are set in accordance with a ratio between efficiency exhibited when a white image is displayed, using the first white unit data and efficiency exhibited when a white image is displayed, using the second white unit data.

In the flat display device according to the second embodiment of the present invention, efficiency exhibited when a white image is displayed, using the first white unit data R'W'B' is higher than efficiency exhibited when a white image is displayed, using the second white unit data R'B'G'. Accordingly, the first driving period, t1, in which a white image is rendered, using the first white unit data R'W'B', is set to be longer than the second driving period, t2, in which white image is displayed, using the second white unit data R'B'G'. That is, the first and second driving periods t1 and t2 are determined to be proportional to the ratio between efficiency E1 exhibited when a white image is displayed, using the first white unit data R'W'B' and efficiency E2 exhibited when a white image is displayed, using the second white unit data R'B'G' (E1:E2=t1:t2).

To this end, the timing controller 110 in the flat display device according to the second embodiment of the present invention includes a control signal generator 120, a four-color data transformer 112, a unit pixel information unit 114, first and second counters 122*a* and 122*b*, and a pixel data processor 118 (refer to FIG. 3). The control signal generator 120, four-color data transformer 112, and unit pixel information unit 114 are similar to those of FIG. 3.

The first and second counters 122*a* and 122*b* supply the first and second white drive signals WDS1 and WDS2 to the pixel data processor 118 when the first and second driving periods t1 and t2 are completely counted, respectively. That is, the first counter 122*a* counts passage of time from a time when power is turned on, and supplies the second white drive signal WDS2 when the counted time corresponds to the first drive period t1. When the first counter 122*a* receives the first white drive signal WDS1 from the second counter 122*b*, the first counter 122*a* counts passage of time from a time when the first white drive signal WDS1 is received. When the counted time corresponds to the first drive period t1, the first counter 122*a* supplies the second white drive signal WDS2 to the pixel data processor 118. When the second counter 122*b* receives the second white drive signal WDS2 from the first counter 122*a*, the second counter 122*b* counts passage of time from a time when the second white drive signal WDS2 is received. When the counted time corresponds to the second drive period t2, the second counter 122*b* supplies the first white drive signal WDS1 to the pixel data processor 118.

The pixel data processor 118 alternately supplies the first white unit data R'W'B' for non-emission of the green sub-pixel SPG and the second white unit data R'B'G' for non-emission of the white sub-pixel SPW in response to the first and second white drive signals WDS1 and WDS2 supplied from the first and second counters 122*a* and 122*b*, respectively. In detail, the pixel data processor 118 extracts red, white, and blue sub-pixel data from four-color data for each unit pixel supplied from the four-color data transformer 114, in response to the first white drive signal WDS1 from the second counter 122*b*. The pixel data processor 118 then corrects the extracted data into first white unit data R'W'B' having color coordinates according to a predetermined target white luminance (refer to FIG. 4A). The pixel data processor 118 supplies the first white unit data R'W'B' to the data driver 104. Accordingly, the white unit pixel P corresponding to white unit pixel information UPI from the unit pixel information unit 114 displays a white image corresponding to the predetermined color coordinates in accordance with driving of the red, white, and blue sub-pixels SPR, SPW, and SPB in the white unit pixel P. In this case, the green sub-pixel SPG in the white unit pixel P displays a black image due to non-driving thereof.

In response to the second white drive signal WDS2 from the first counter 122*a*, the pixel data processor 118 extracts red, green, and blue sub-pixel data from four-color data for each unit pixel supplied from the four-color data transformer 114. The pixel data processor 118 then corrects the extracted data into second white unit data R'B'G' having color coordinates according to a predetermined target white luminance (refer to FIG. 4B). The pixel data processor 118 supplies the second white unit data R'B'G' to the data driver 104. Accordingly, the white unit pixel P corresponding to white unit pixel information UPI from the unit pixel information unit 114 displays a white image corresponding to the predetermined color coordinates in accordance with driving of the red, green, and blue sub-pixels SPR, SPG, and SPB in the white unit pixel P. In this case, the white sub-pixel SPW in the white unit pixel P displays a black image due to non-driving thereof.

Figure 7:
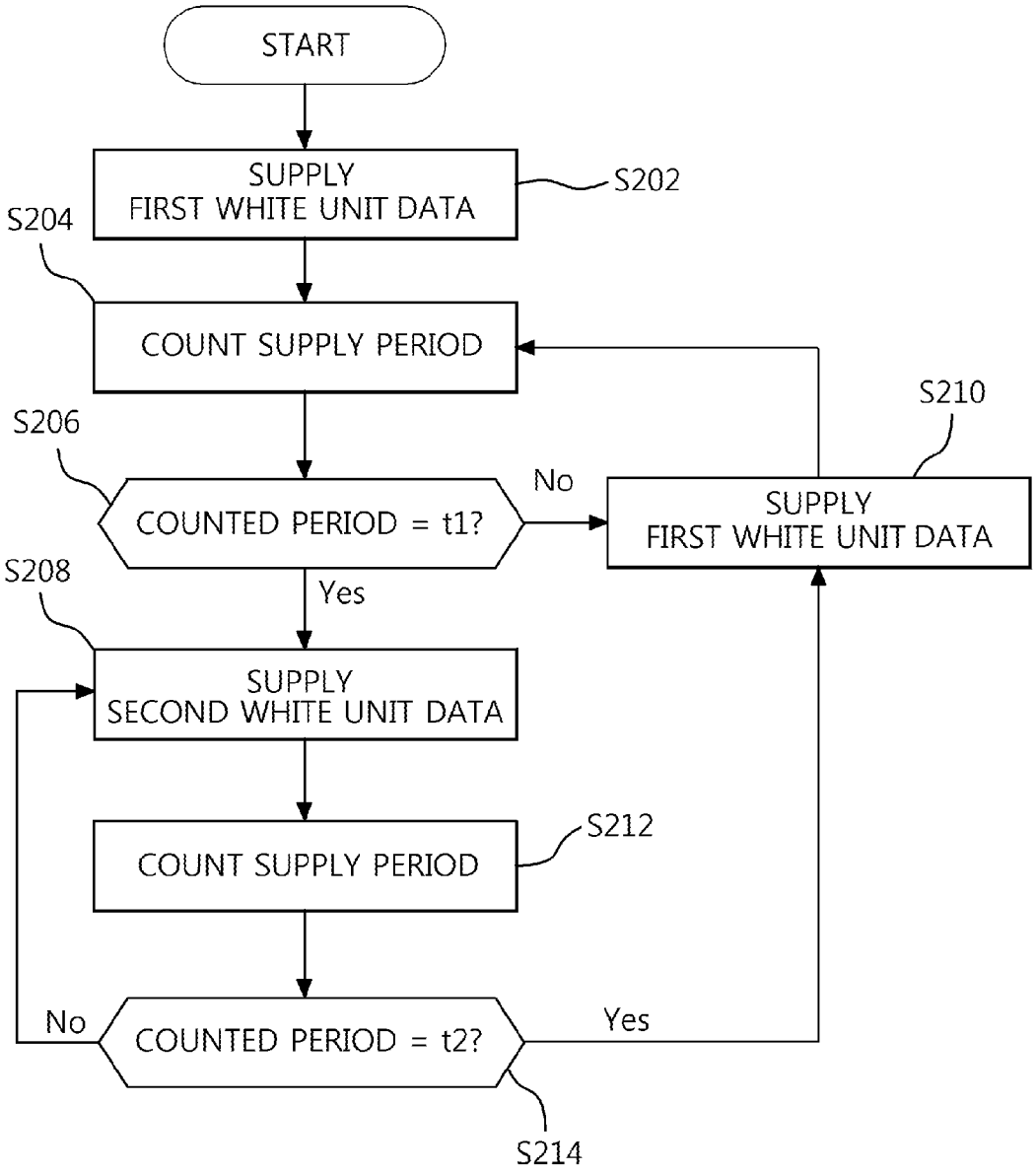
FIG. 7 is a flowchart explaining a method for driving the flat display device according to the second embodiment of the present invention.

Next, FIG. 7 is a flowchart explaining a method for driving the flat display device according to the second embodiment of the present invention. When the flat display device is initially driven after being powered on, first white unit data R'W'B' is supplied to display a white image on a corresponding unit pixel (S202). A period, in which the first white unit data R'W'B' is supplied to display a white image, is then counted (S204). Thereafter, it is determined whether the counted period corresponds to the first driving period t1 (S206). When the counted period does not correspond to the first driving period t1, namely, when a white image is displayed, using the first white unit data R'W'B', in a period shorter than the first driving period t1, the first white unit data R'W'B' is continuously supplied to continuously display the white image on the corresponding unit pixel (S210). On the other hand, when the counted period corresponds to the first driving period t1, namely, after a white image is displayed, using the first white unit data R'W'B', during the first driving period t1, second white unit data R'G'B' is supplied to display a white image on the corresponding unit pixel (S208).

Thereafter, a period, in which the second white unit data R'G'B' is supplied to display a white image, is counted (S212). It is then determined whether the counted period corresponds to the second driving period t2 (S214). When the counted period does not correspond to the second driving period t2, namely, when a white image is displayed, using the second white unit data R'G'B', in a period shorter than the second driving period t2, the second white unit data R'G'B' is continuously supplied to continuously display the white image on the corresponding unit pixel (S208). When the counted period corresponds to the second driving period t2, namely, after a white image is displayed, using the second white unit data R'G'B', during the second driving period t2, first white unit data R'W'B' is supplied to display a white image on the corresponding unit pixel (S210).

When a white image is displayed during the first driving period t1, using the first white unit data R'W'B', as described above, the threshold voltage of the driving transistor of the non-driving green sub-pixel SPG is shifted to a certain value in the negative direction. Accordingly, during the second driving period t2, a white image is displayed, using the second white unit data R'B'G' for driving of the green sub-pixel SPG. As a result, it may be possible to prevent the threshold voltage of the green sub-pixel SPG from being shifted in the negative direction beyond a compensation range.

When a white image is displayed during the second driving period t2, using the second white unit data R'B'G', the threshold voltage of the driving transistor of the driving green sub-pixel SPG is shifted to a certain value in the positive direction. Accordingly, during the first driving period t1, a white image is displayed, using the first white unit data R'W'B' for non-driving of the green sub-pixel SPG. As a result, it may be possible to prevent the threshold voltage of the green sub-pixel SPG from being shifted in the positive direction beyond a compensation range.

Figure 8:
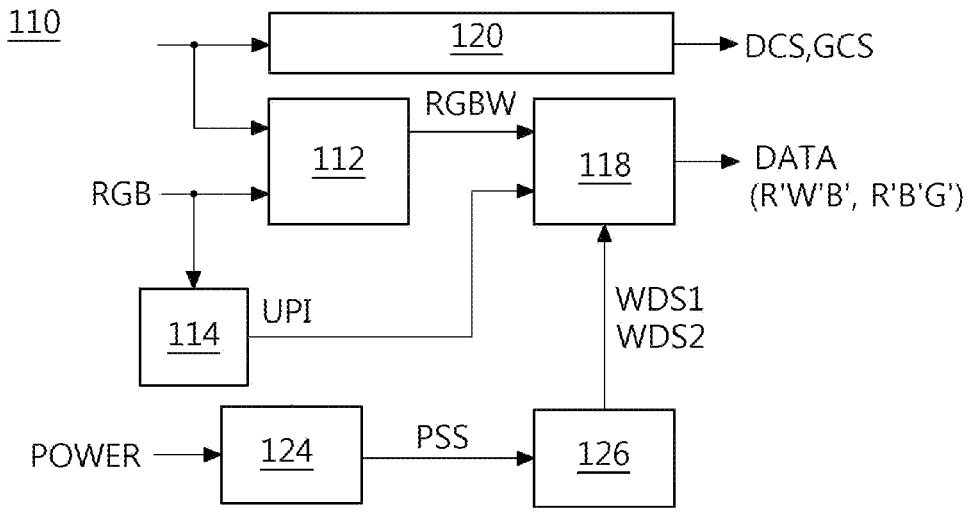
FIG. 8 is a block diagram illustrating a flat display device according to a third embodiment of the present invention.

Next, FIG. 8 is a block diagram illustrating a flat display device according to a third embodiment of the present invention. The flat display device according to the third embodiment of the present invention illustrated in FIG. 8 includes similar constituent elements as the flat display devices according to the first and second embodiments of the present invention, in which the first and second white unit data are transformed upon rendering an image, except that the first and second white unit data are transformed when power is turned off.

The timing controller 110 in the flat display device according to the third embodiment of the present invention includes a control signal generator 120, a four-color data transformer 112, a unit pixel information unit 114, a power sensor 124, a power counter 126, and a pixel data processor 118. The control signal generator 120, four-color data transformer 112, and unit pixel information unit 114 are similar to those of FIG. 3.

The power sensor 124 senses turning-on or off of power of the display panel, and generates a sensing signal, based on results of the sensing operation. The power counter 126 counts sensing signals PSS from the power sensor 124, and supplies the first and second white drive signals WDS1 and WDS2 to the pixel data processor 118, based on results of the counting operation. In detail, when the power sensor 124 senses turning-off of power, the power counter 126 counts sensing signals PSS. When an odd number of sensing signals PSS is counted, the power counter 126 supplies the second white drive signal WDS2 to the pixel data processor 118. When an even number of sensing signals PSS is counted, the power counter 126 supplies the first white drive signal WDS1 to the pixel data processor 118.

When the power sensor 124 senses turning-on of power, the power counter 126 counts sensing signals PSS. When an odd number of sensing signals PSS is counted, the power counter 126 supplies the first white drive signal WDS1 to the pixel data processor 118. When an even number of sensing signals PSS is counted, the power counter 126 supplies the second white drive signal WDS2 to the pixel data processor 118.

The pixel data processor 118 alternately supplies the first white unit data R'W'B' for non-emission of the green sub-pixel SPG and the second white unit data R'B'G' for non-emission of the white sub-pixel SPW in response to the first and second white drive signals WDS1 and WDS2 supplied from the power counter 126. In particular, when the power sensor 124 senses turning-off of power, the pixel data processor 118 stores the first and second white drive signals WDS1 and WDS2 supplied when power is turned off, and alternately supplies the first white unit data R'W'B' for non-emission of the green sub-pixel SPG and the second white unit data R'B'G' for non-emission of the white sub-pixel SPW in response to the first and second white drive signals WDS1 and WDS2 stored when power is turned on.

In detail, the pixel data processor 118 extracts red, white, and blue sub-pixel data from four-color data for each unit pixel supplied from the four-color data transformer 114, in response to the first white drive signal WDS1 from the power counter 126. The pixel data processor 118 then corrects the extracted data into first white unit data R'W'B' having color coordinates according to a predetermined target white luminance, as illustrated in FIG. 4A. The pixel data processor 118 supplies the first white unit data R'W'B' to the data driver 104. Accordingly, the white unit pixel P corresponding to white unit pixel information UPI from the unit pixel information unit 114 displays a white image corresponding to the predetermined color coordinates in accordance with driving of the red, white, and blue sub-pixels SPR, SPW, and SPB in the white unit pixel P. In this case, the green sub-pixel SPG in the white unit pixel P displays a black image due to non-driving thereof.

In response to the second white drive signal WDS2 from the power counter 126, the pixel data processor 118 extracts red, green, and blue sub-pixel data from four-color data for each unit pixel supplied from the four-color data transformer 114. The pixel data processor 118 then corrects the extracted data into second white unit data R'B'G' having color coordinates according to a predetermined target white luminance, as illustrated in FIG. 4B. The pixel data processor 118 supplies the second white unit data R'B'G' to the data driver 104. Accordingly, the white unit pixel P corresponding to white unit pixel information UPI from the unit pixel information unit 114 displays a white image corresponding to the predetermined color coordinates in accordance with driving of the red, green, and blue sub-pixels SPR, SPG, and SPB in the white unit pixel P. In this case, the white sub-pixel SPW in the white unit pixel P displays a black image due to non-driving thereof.

Figure 9:
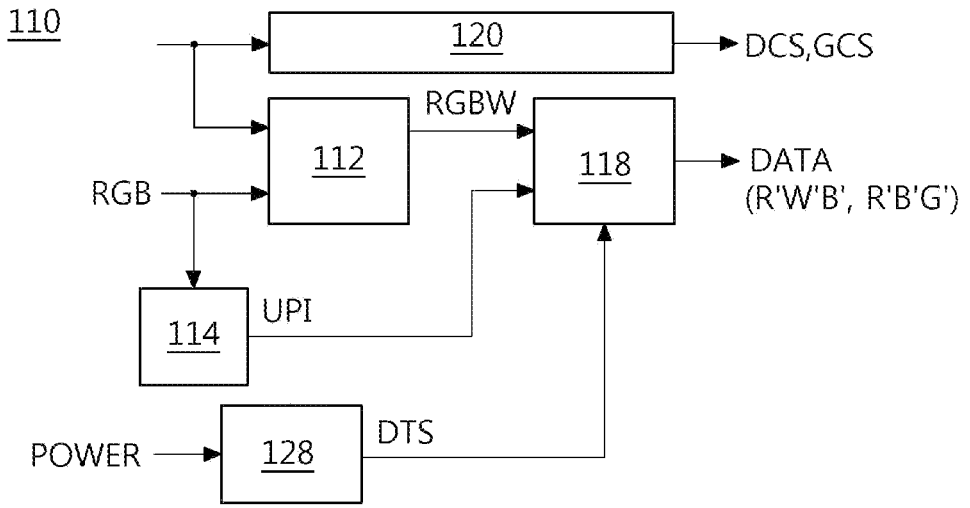
FIG. 9 is a block diagram illustrating a flat display device according to a fourth embodiment of the present invention.

Next, FIG. 9 is a block diagram illustrating a flat display device according to a fourth embodiment of the present invention. The flat display device according to the fourth embodiment of the present invention includes similar constituent elements as the flat display devices according to the first to third embodiments of the present invention, except that the first and second white unit data are alternately used to render a white image at intervals of a predetermined time.

The timing controller 110 in the flat display device according to the fourth embodiment of the present invention includes a control signal generator 120, a four-color data transformer 112, a unit pixel information unit 114, a counter 128, and a pixel data processor 118. The control signal generator 120, four-color data transformer 112, and unit pixel information unit 114 are similar to those of FIG. 3.

The counter 128 counts passage of time from a time when power is turned on, and generates a data transformation signal DTS at intervals of a predetermined time (for example, several seconds or n frames (n being a natural number)). The counter 128 supplies the data transformation signal DTS to the pixel data processor 118.

The pixel data processor 118 supplies white unit data different from that of a previous frame in response to the data transformation signal DTS supplied from the counter 126. That is, when a white image is rendered, using the first white unit data in the previous frame, the pixel data processor 118 supplies the second white unit data during the first driving period in response to the data transformation signal DTS. When a white image is rendered, using the second white unit data in the previous frame, the pixel data processor 118 supplies the first white unit data during the second driving period in response to the data transformation signal DTS. In this case, the first and second driving periods alternate in accordance with the data transformation signal generated at intervals of a predetermined time and, as such, have the same fixed value.

When a white image is displayed during the first driving period, using the first white unit data R'W'B', as described above, the threshold voltage of the driving transistor of the non-driving green sub-pixel SPG is shifted to a certain value in the negative direction. Accordingly, during the second driving period, a white image is displayed, using the second white unit data R'B'G' for driving of the green sub-pixel SPG. As a result, it may be possible to prevent the threshold voltage of the green sub-pixel SPG from being shifted in the negative direction beyond a compensation range.

When a white image is displayed during the second driving period, using the second white unit data R'B'G', the threshold voltage of the driving transistor of the driving green sub-pixel SPG is shifted to a certain value in the positive direction. Accordingly, during the first driving period, a white image is displayed, using the first white unit data R'W'B' for non-driving of the green sub-pixel SPG. As a result, it may be possible to prevent the threshold voltage of the green sub-pixel SPG from being shifted in the positive direction beyond a compensation range.

Figure 10A:
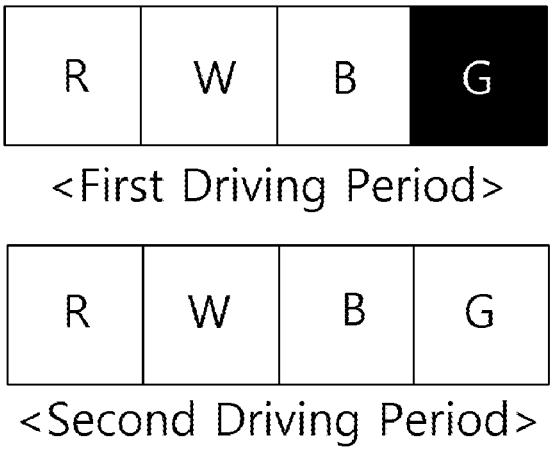
FIGS. 10A and 10B are diagrams explaining a method for rendering a white image on a unit pixel included in a flat display device according to a fifth embodiment of the present invention.
Figure 10B:
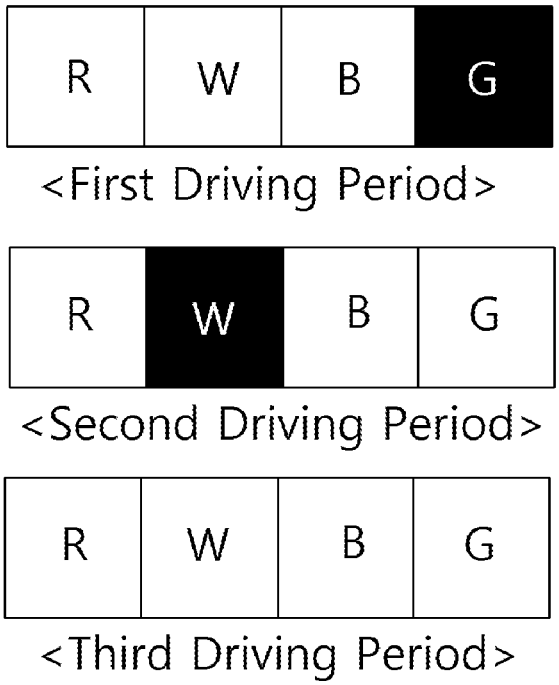

Although the fourth embodiment of the present invention has been described in conjunction with the example in which the first and second driving periods alternate at intervals of a predetermined time, the first and second driving periods may be randomly (variably) alternated. In addition, although the present invention has been described in conjunction with the example in which three of the four sub-pixels included in each unit pixel are used to display a white image on the unit pixel, all the red, green, blue, and white sub-pixels may be driven to render corresponding colors in one of the first and second driving periods, as illustrated in FIG. 10A. Alternatively, as illustrated in FIG. 10B, the panel driving unit of the present invention may drive the red, blue, and white sub-pixels in the first driving period, may drive the red, green, and blue sub-pixels in the second driving period, and may drive the red, green, blue, and white sub-pixels in a third driving period. In this case, the third driving period follows at least one of the first and second driving periods.

The embodiments of the present invention other than the first embodiment of the present invention applied to an organic light emitting device are applicable not only to an organic light emitting device and a liquid crystal display device, but also to any flat display device.

As apparent from the above description, in the flat display device according to the present invention, two of the red, green, and blue sub-pixels and the white sub-pixel in the unit pixel are driven during the first driving period, and at least three of the sub-pixels in the unit pixel, which include the sub-pixel not driven in the first driving period, are driven during the second driving period alternating with the first driving period, in order to display a white image on the unit pixel. As a result, it may be possible to prevent the threshold voltage of the driving transistor in the sub-pixel not driven during the first driving period from being shifted. Accordingly, it may be possible to prevent an increase in luminance and to achieve an enhancement in reliability.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A flat display device comprising:

a display panel including a unit pixel having a red sub-pixel, a green sub-pixel, a blue sub-pixel, and a white sub-pixel; and a panel driver including a data driver, a scan driver and a timing controller, wherein the panel driver drives the display panel in a first driving period and a second driving period in an alternating manner to display a white image on the unit pixel, wherein the panel driver enables two of the red, green, and blue sub-pixels and the white sub-pixel to be driven in the first driving period and generates first white unit data, wherein the panel driver enables three of the sub-pixels, which include the sub-pixel not driven in the first driving period, to be driven in the second driving period and generates second white unit data, and wherein the panel driver sets the first and second driving periods such that the first driving period is longer than the second driving period.

2. The flat display device according to claim 1, wherein the display panel is a liquid crystal panel or an organic light emitting display panel.

3. The flat display device according to claim 2, wherein the panel driver includes:

a first counter configured to count a period in which the white image is rendered, using the first white unit data, and generate a second white drive signal when the counted period is equal to the set first driving period, a second counter configured to count a period in which the white image is rendered, using the second white unit data, and generate a first white drive signal when the counted period is equal to the set second driving period, and a pixel data processor configured to generate the first white unit data to enable one of the red, green, and blue sub-pixels to display a black image, in response to the first white drive signal, and generate the second white unit data to enable the white sub-pixel to display a black image in the second driving period, in response to the second white drive signal.

4. The flat display device according to claim 1, wherein, when the white image is displayed on the unit pixel in one of the first and second driving periods, the red, green, blue, and white sub-pixels in the unit pixel are driven.

5. The flat display device according to claim 1, wherein the panel driver drives the red, green, blue, and white sub-pixels in the unit pixel in a third driving period following at least one of the first and second driving period.

6. A method of driving a display device, the method comprising:

providing a unit pixel in a display panel, the unit pixel having a red sub-pixel, a green sub-pixel, a blue sub-pixel, and a white sub-pixel, the display panel including a panel driver;

driving the display panel in a first driving period and a second driving period in an alternating manner; and displaying a white image on the unit pixel, wherein the panel driver enables two of the red, green, and blue sub-pixels and the white sub-pixel to be driven in the first driving period and generates first white unit data, wherein the panel driver enables three of the sub-pixels, which include the sub-pixel not driven in the first driving period, to be driven in the second driving period and generates second white unit data, and wherein the panel driver sets the first and second driving periods such that the first driving period is longer than the second driving period.

7. The method according to claim 6, wherein the display panel is a liquid crystal display panel or an organic light emitting display panel.

8. The method according to claim 7, wherein the panel driver includes:

a first counter configured to count a period in which the white image is rendered, using the first white unit data, and generate a second white drive signal when the counted period is equal to the set first driving period, a second counter configured to count a period in which the white image is rendered, using the second white unit data, and generate a first white drive signal when the counted period is equal to the set second driving period, and a pixel data processor configured to generate the first white unit data to enable one of the red, green, and blue sub-pixels to display a black image, in response to the first white drive signal, and generate the second white unit data to enable the white sub-pixel to display a black image in the second driving period, in response to the second white drive signal.

9. The method according to claim 6, wherein, when the white image is displayed on the unit pixel in one of the first and second driving periods, the red, green, blue, and white sub-pixels in the unit pixel are driven.

10. The method according to claim 6, wherein the panel driver drives the red, green, blue, and white sub-pixels in the unit pixel in a third driving period following at least one of the first and second driving period.

* * * * *